US006409171B1

(12) United States Patent
Schultz et al.

(10) Patent No.: US 6,409,171 B1
(45) **Date of Patent: *Jun. 25, 2002**

(54) METHOD AND APPARATUS FOR PLAYING GOLF TRIVIA GAME

(76) Inventors: Scott Schultz, 131 Charles St.; Robert Davidson, 2509 Hirst Ter., both of Havertown, PA (US) 19083

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/111,940

(22) Filed: Jul. 8, 1998

(51) Int. Cl.[7] ..... A63F 3/00
(52) U.S. Cl. ..... 273/245; 273/277
(58) Field of Search ..... 273/245, 236, 273/243, 268, 249, 277, 254, 432

(56) References Cited

U.S. PATENT DOCUMENTS

| | | | | | |
|---|---|---|---|---|---|
| 1,635,734 | A | * | 7/1927 | Ziegler | 273/249 |
| 3,826,498 | A | * | 7/1974 | Monek | 273/249 |
| 4,273,337 | A | * | 6/1981 | Carrea et al. | 273/243 |
| 4,856,780 | A | * | 8/1989 | Begley et al. | 273/244 |
| 4,953,871 | A | * | 9/1990 | Antwi | 273/252 |
| 5,112,057 | A | * | 5/1992 | Popovic | 273/243 |
| 5,121,928 | A | * | 6/1992 | Salerno-Sonneberg | 273/243 |
| 5,211,402 | A | * | 5/1993 | Feruson et al. | 273/249 |
| 5,261,671 | A | * | 11/1993 | Wyatt | 273/249 |
| 5,295,834 | A | * | 3/1994 | Saunders | 434/128 |
| 5,308,077 | A | * | 5/1994 | Caggiano | 273/243 |
| 5,472,207 | A | * | 12/1995 | Sullivan, Jr. et al. | 273/249 |
| 5,487,548 | A | * | 1/1996 | Daley et al. | 273/431 |
| 5,692,751 | A | * | 12/1997 | Morrissey et al. | 273/245 |
| 5,738,354 | A | * | 4/1998 | Easley | 273/249 |
| 5,839,725 | A | * | 11/1998 | Conway | 273/244 |

* cited by examiner

*Primary Examiner*—Paul T. Sewell
*Assistant Examiner*—M. Chambers
(74) *Attorney, Agent, or Firm*—Duane Morris LLP

(57) ABSTRACT

A method of play of a golf trivia game is provided in which a question category is randomly selected from among two or more question categories. A question is then directed from the selected category to a player. A random value is assigned to a correct answer, and a random value is assigned to an incorrect answer. A determination of the correctness of the answer is made, and the score is recorded depending on the assigned random value. Each player answers one question per round or hole, and the game is completed after a selected number of rounds have been played. By providing a score for each player for each round of questions, this method provides the same variety of ways of playing the game as the game of golf itself.

9 Claims, 3 Drawing Sheets

200

| HANDICAP | 7 | 11 | 15 | 1 | 9 | 3 | 13 | 17 | 5 | | 10 | 2 | 16 | 8 | 14 | 4 | 18 | 12 | 6 | | | |
|---|---|---|---|---|---|---|---|---|---|---|---|---|---|---|---|---|---|---|---|---|---|---|
| | | | | | | | | | | | | | | | | | | | | | | |
| | | | | | | | | | | | | | | | | | | | | | | |
| | | | | | | | | | | | | | | | | | | | | | | |
| | | | | | | | | | | | | | | | | | | | | | | |
| HOLE | 1 | 2 | 3 | 4 | 5 | 6 | 7 | 8 | 9 | OUT | 10 | 11 | 12 | 13 | 14 | 15 | 16 | 17 | 18 | IN | TOTAL | |
| PAR | 4 | 4 | 3 | 4 | 5 | 4 | 3 | 4 | 4 | 35 | 4 | 4 | 3 | 4 | 5 | 4 | 3 | 4 | 4 | 35 | 70 | |
| | | | | | | | | | | | | | | | | | | | | | | |
| | | | | | | | | | | | | | | | | | | | | | | |
| | | | | | | | | | | | | | | | | | | | | | | |
| | | | | | | | | | | | | | | | | | | | | | | |

210

220

FIG. 3

METHOD AND APPARATUS FOR PLAYING GOLF TRIVIA GAME

FIELD OF THE INVENTION

This invention relates to games, and in particular question and answer games.

BACKGROUND OF THE INVENTION

The game of golf is extremely popular. One of the reasons is that the scoring system provides a wide variety of methods of play. For example, players may compete individually for the lowest score on a course. Players may compete in teams of two or more players, and may count all holes of each player, or only selected holes, such as the best hole, for each team.

There have been many efforts to provide games for sedentary play, such as board games and trivia games, that provide the interest of the game of golf. Even the most avid golfer may, because of poor weather conditions, darkness, or desire for ready access to refreshments, prefer to play a golf trivia game or the like from time to time. However, such games have not succeeded in recreating the variety of scoring options of the game of golf.

SUMMARY OF THE INVENTION

According to one aspect of the invention, a method of play of a golf trivia game is provided in which a question category is randomly selected from among two or more question categories. A question is then directed from the selected category to a player. A random value is assigned to a correct answer, and a random value is assigned to an incorrect answer. A determination of the correctness of the answer is made, and the score is recorded. Each player answers one question per round or hole, and the game is completed after a selected number of rounds have been played. By providing a score for each player for each round of questions, this method provides the same variety of ways of playing the game as the game of golf itself.

According to another aspect of the invention, an apparatus for playing a golf trivia game includes question and answer cards. Each of the cards has on one face thereof more than one question. Each question has associated therewith a symbol identifying a question category, and on an opposite face, answers to each of the questions. An apparatus is provided for randomly selecting one of the categories. An apparatus is also provided for randomly selecting a value for a correct answer; and an apparatus is provided for randomly selecting a value for an incorrect answer.

BRIEF DESCRIPTION OF THE FIGURES

FIG. 3 depicts a representative scorecard for use in accordance with the invention.

DETAILED DESCRIPTION OF AN EMBODIMENT

Figure 1B:
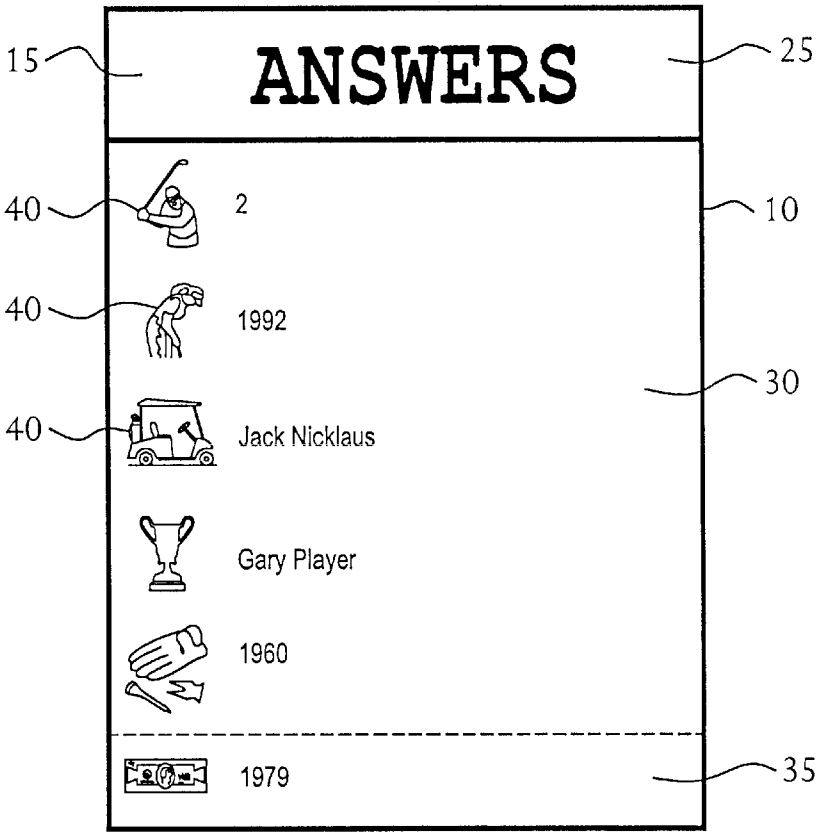
FIGS. 1 and 1B depict the two opposite sides of a representative question and answer card according to the invention.
Figure 1A:
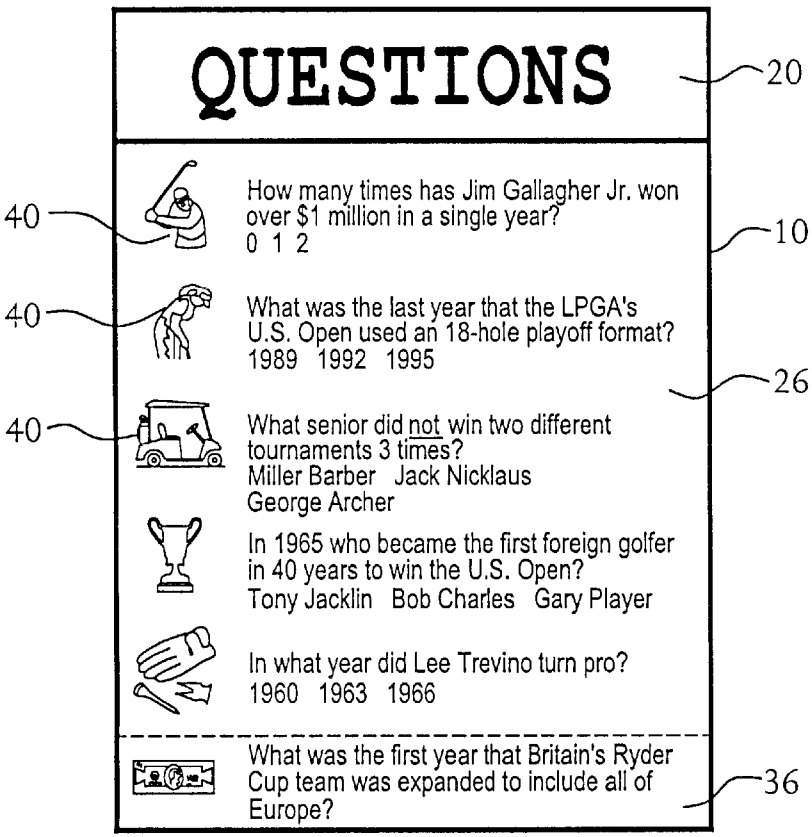

Referring to FIGS. 1A and 1B, there are provided question and answer cards 10. Each card 10 has a first side, or question side, 15, and an opposite side, or answer side, 20. Question side 15 has thereon questions 25, including standard questions 30, and questions 35 having a numerical answer. If questions 25 are multiple-choice questions, the possible answers are also printed on question side 15. Each question 25 has associated therewith symbol 40. Each symbol 40 corresponds to a category of question. Categories may represent subject matter area, type of question, or other manner of categorization of question. Answer side has answers 26 to questions 25. Answers are grouped appropriately in categories with the category symbols. Numerical answer 36 is also provided to question 35.

Figure 2:
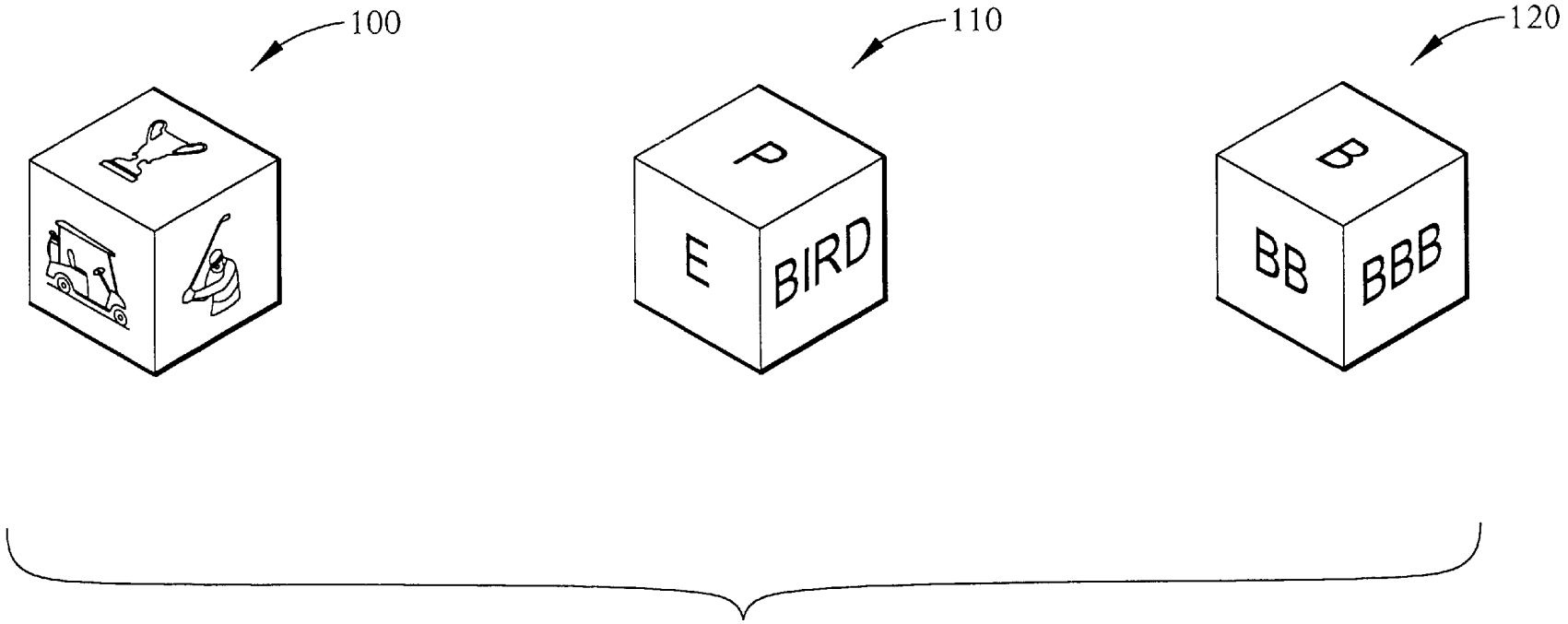
FIG. 2 depicts representative dice according to the invention.

Referring to FIG. 2, there are depicted three dice. Category die 100 has on each side a symbol identical to a category symbol 40. In this embodiment, die 100 is a cube, and there are only five categories. One side of die 100 is marked with a symbol indicating that the person to whom the question is directed may select the category. Die 110 represents values for a correct answer. For example, three sides may have the letter P, for par, two sides may have the word BIRD, for birdie, and one side may have the letter E, for eagle. Die 120 represents the values for an incorrect answer. For example, three sides may have the symbol B, for bogie, two sides may have BB, for double bogie, and one side may have BBB, for triple bogie. The ranges of values on dice 110 and 120 are different. In the example, the ranges do not overlap. Dice 100, 110, and 120 are preferably three distinct colors to minimize confusion among the three dice.

Referring now to FIG. 3, there is depicted an exemplary scorecard 200 according to the invention. As with a conventional golf scorecard, scorecard 200 has horizontal and vertical lines defining a matrix of blocks arranged in rows and columns. A central row 210 has the word HOLE in a left-hand column. The numbers 1 through 18 appear in succession from right to left in blocks in row 210. The word OUT appears in the block after the number 9; it is, as conventional, a heading for a column of subtotals. Similarly, the word IN appears in a block to the right of the number 18, and the word TOTAL appears on the far right. In the block immediately below the word HOLE appears the word PAR. This block is the left-hand block of row 220. In row 220 to the right of the word PAR are provided numerical par values for each hole. The values of par are preprinted. A series of blank spaces are provided in the left-hand column for players' names, and blank spaces are provided in corresponding rows for player scores. A HANDICAP row is provided across the top of scorecard 200, with sample handicaps for the holes. Players may determine their handicaps based on their knowledge of golf trivia, and thereby equalize the competition, just as players of varying skill levels in golf may employ handicaps to equalize the competition.

Play proceeds as follows. In order to determine the order of play, one player selects a card 10, and reads from card 10 question 35, which has a numerical answer. Each player writes down an answer on a piece of paper. The answers are read, and the player who asked the question then turns card 10 over to read answer 36 to question 35, which answer is on answer side 20. The player with the answer closest to the correct answer 36 proceeds first.

The first player rolls dice 100, 110 and 120, preferably simultaneously. The category symbol that is on the upper side of die 100 after the roll determines the category of the first question to be asked. A player other than the first player takes a card 10, and asks the question corresponding to the category symbol on the upper side of die 100. The first player then answers, and the player posing the question looks at the answer on the answer side 20 of card 10. If the answer is correct, die 110 is consulted to determine the score for the hole. The score is determined by taking the par value of the hole from row 220 of scorecard 200, and then adjusting the score as required by the indication on the upper side of die 110. For example, if die 110 reads P, then the score is par for the hole. If die 110 reads B, for birdie, the score is one subtracted from par. The resulting score is recorded on scorecard 200, just as in the game of golf.

If the first player's answer is incorrect, die 120 is consulted for the value of the answer, and accordingly the player's score for that round or hole. If the upper side of die 120 is B, then the value is one added to par, and so forth. The score is recorded on scorecard 200.

Then the second player, generally the player who was second-closest to the correct answer in answering question 35 above, rolls dice 100, 110 and 120. Play proceeds as with the first player.

At any time, if a tie-breaker is desired, question 35 having a numerical answer may be employed as described above.

It will readily be understood that this game permits all of the variations of play involved in the game of golf. For example, the players may be divided into teams, and play best ball matches, in which only the best score for each team for each hold is recorded. In alternate shot matches, players are divided into teams, and the player from each team to answer the question alternates or rotates. In scrambles, the players are divided into teams. A question is directed to an entire team, and the players on that team confer on an answer. After the answer is given, each player on the team rolls die 110 or 120, as appropriate depending on whether the answer was correct or incorrect, and the lowest score of all of the players is recorded.

It will be understood that as the scores are determined randomly, and independently of one another, the game is made more exciting. Of course, it will be understood that in random selection of categories and scores for correct and incorrect answers, dice are not the only means of selection. Any device directed to produce a random answer constitutes a means for randomly selecting a category and a value of an answer. For example, a rotatable wheel marked with various possible values and a pointer to indicate the value may be employed. Alternatively, various electronic devices could be employed to generate random numbers within a desired range. It will also be understood that while the questions and answers are disclosed as appearing on opposite sides of thin cards, other means of presentation of questions and answers may be provided. For example, means for presentation of questions and answers include sheets of paper, booklets, or various types of electronic devices with readable displays, and input for selection of questions.

The game may be implemented on a computer. A program may run on a single personal computer, or a program may run in a client/server environment. In that situation, the program would run on the server, and each player might have a client personal computer. For example, in an initial screen, the computer may provide prompts for player names and assignment of players to teams, if appropriate. The computer may provide a question having a numerical value, and prompt each player to enter an answer associated with their name. The computer then could assign an order of play. The computer could randomly select a category and scores for correct and incorrect answers. The computer would then prompt the first player to answer a question. The computer could maintain and display the score. In the computer-implemented version, the programmable computer and/or elements of a network constitute means for presentation of questions and answers and means for random selection of values. Of course, a wide variety of programmable devices, including personal computers and special purpose portable electronic game devices may be employed.

It will be understood that various changes in the details, materials and arrangements of the parts which have been described and illustrated above in order to explain the nature of this invention may be made by those skilled in the art without departing from the principle and scope of the invention as recited in the following claims.

What is claimed is:

1. A method of play of a golf trivia game, comprising the steps of:

randomly selecting a question category from one of a plurality of question categories;

directing a question pertaining to the game of golf from said selected category to a player;

assigning a value, at least in part randomly, to an incorrect answer;

assigning a value, at least in part randomly, and independently from the step of assigning a value to an incorrect answer, to a correct answer;

determining whether the answer given by the player is correct; and determining whether the answer given by the player is correct; and recording a score equal to the value of the answer.

2. The method of claim 1, wherein said step of randomly selecting a question category comprises rolling a die having on each side thereof a symbol, each of said symbols uniquely identifying a question category.

3. The method of claim 2, wherein said step of directing a question comprises selecting the question from a card having a plurality of questions, each of said questions belonging to one of said categories, and having associated therewith the symbol identifying one of said categories.

4. The method of claim 1, wherein said step of assigning a value to an incorrect answer comprises randomly selecting a number from a first range of possible values.

5. The method of claim 4, wherein said step of assigning a value to a correct answer comprises randomly selecting a number from a second range.

6. The method of claim 1, wherein the score is determined based on a value on a scorecard for a hole, and on the random value determined for a correct and for an incorrect answer.

7. The method of claim 1, further comprising the step of, to determine an order of play, directing a question having a numerical answer to all players, having all players provide an answer, and determining the order of play based on the difference between each players's answer and the correct answer.

8. The method of claim 1, wherein said question pertains to the game of golf, and each of said steps is conducted once for each one of a plurality of competitors for each one of a plurality of rounds;

said method further comprising the steps of calculating a total score for each one of said competitors by adding, for each one of said competitors, the score for each of said rounds, and declaring as the winner that competitor having the lowest total score.

9. The method of claim 8, wherein said step of assigning a value to a correct answer comprises adding to or subtracting from a par value for the round then being played a value from a first range of numerical values, and said step of assigning a value to an incorrect answer comprises adding to or subtracting from a par value for the round then being played a value from a second range of numerical values.

* * * * *